United States Patent [19]

Kuehl

[11] 4,026,616

[45] May 31, 1977

[54] COMBINATION CABINET AND ROLL OUT DRAWER CART

[76] Inventor: Wilbert F. Kuehl, 528 Britain Ave., Benton Harbor, Mich. 49022

[22] Filed: Mar. 24, 1975

[21] Appl. No.: 561,430

[52] U.S. Cl. ..... 312/250; 312/201; 312/278; 312/327

[51] Int. Cl.[2] ..... A47B 88/00; A47B 87/00

[58] Field of Search ..... 312/250, 330, 332, 350, 312/201, 140.4, 140.1, 320, 278, 236, 235 R

[56] References Cited

FOREIGN PATENTS OR APPLICATIONS 160,926 9/1954 Australia ..... 312/235 R

*Primary Examiner*—Paul R. Gilliam
*Assistant Examiner*—Victor N. Sakran
*Attorney, Agent, or Firm*—Oltsch & Knoblock

[57] ABSTRACT

A cabinet having a front opening therein and into which a roll out drawer is fitted. The opening in the cabinet extends upwardly from the foundation which supports the cabinet with the roll out drawer including wheels to facilitate its removal from the cabinet opening and its replacement into the opening. The roll out drawer may include a plurality of open shelves or carry several individual drawers which are supported within the roll out drawer.

2 Claims, 7 Drawing Figures

Fig. 1
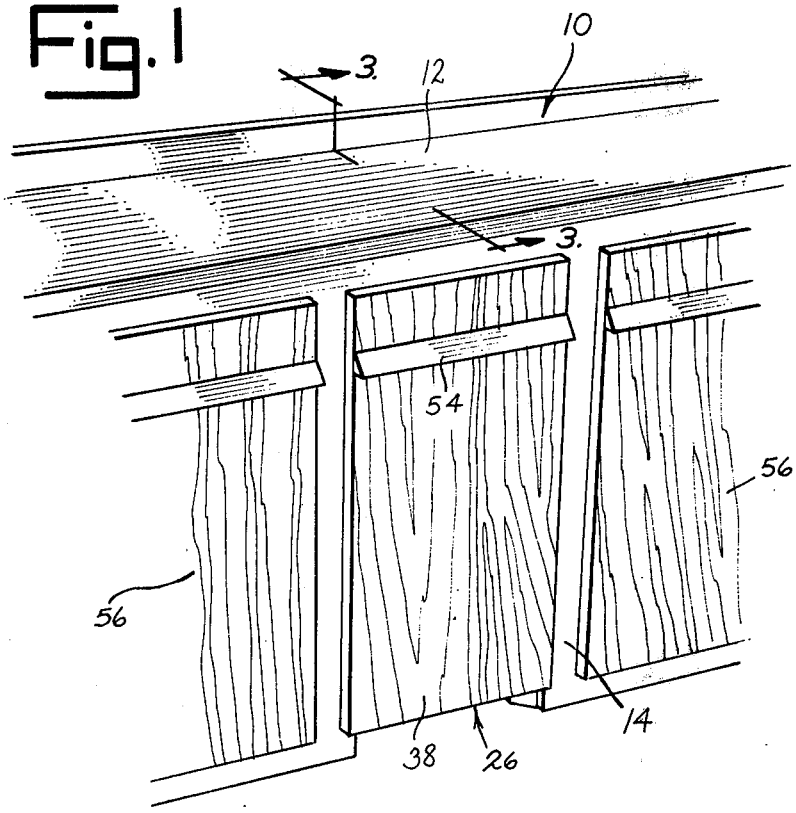
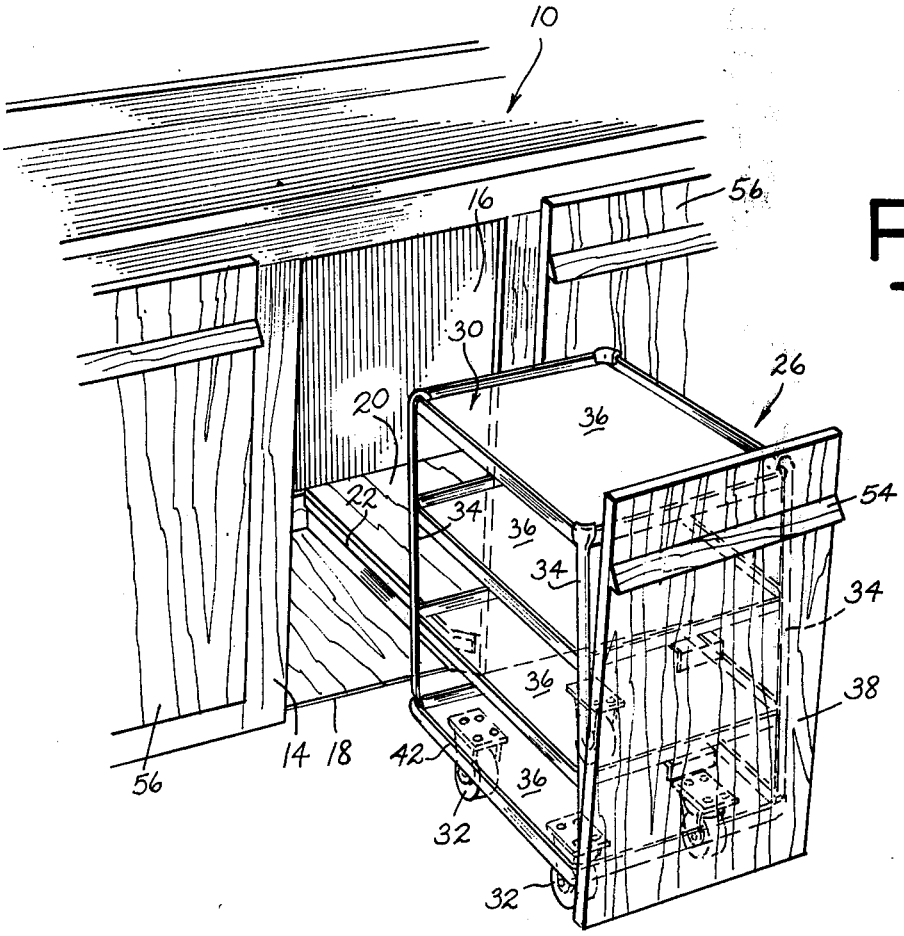
Fig. 2

COMBINATION CABINET AND ROLL OUT DRAWER CART

SUMMARY OF THE INVENTION

This invention relates to a cabinet having one or more roll out drawers fitted therein.

The cabinet and roll out drawer combination of this invention includes a housing member having a generally flat top which may be used as a working surface and having a front opening which extends to the cabinet floor or similar foundation upon which the housing member rests. The drawer is supported upon rollers and is fitted into the front opening in the housing member. The drawer is removed from the housing member by pulling, with the wheels of the drawer rolling over the floor or similar foundation. When the drawer is fitted into the housing member there is preferably wedging engagement between the drawer and housing member to cause the drawer to be securely retained within the housing member opening until again pulled from the housing member. Each drawer may contain a plurality of open shelves or be constructed so as to carry a plurality of individual small pull out drawers. The front of the cabinet housing member and the front panel of the roll out drawer can be constructed so as to slant downwardly and rearwardly, thus providing a toe space without incorporating the usual recess formed at floor level in most cabinets having vertical fronts and hinged doors or ordinary pull out drawers.

Accordingly, it is an object of this invention to provide a cabinet having one or more drawers which are each supported upon rollers and which are each rolled over the cabinet floor or supporting foundation into and out of a front opening formed in the cabinet.

Another object of this invention is to provide a cabinet which can be utilized in the kitchen, workshop or as a desk and which includes one or more floor supported roll out drawers of easy accessibility.

Still another object of this invention is to provide a combination cabinet and roll out drawer of simple operation and of economical manufacture.

Other objects of this invention will become apparent upon a reading of the invention's description.

BRIEF DESCRIPTION OF THE DRAWINGS

FIG. 1 is a perspective view of a cabinet for use in the kitchen having a roll out drawer shown in its closed position.

FIG. 2 is a perspective view of the cabinet of FIG. 1 shown with its roll out drawer in its open position.

DESCRIPTION OF THE PREFERRED EMBODIMENTS

Figure 3:
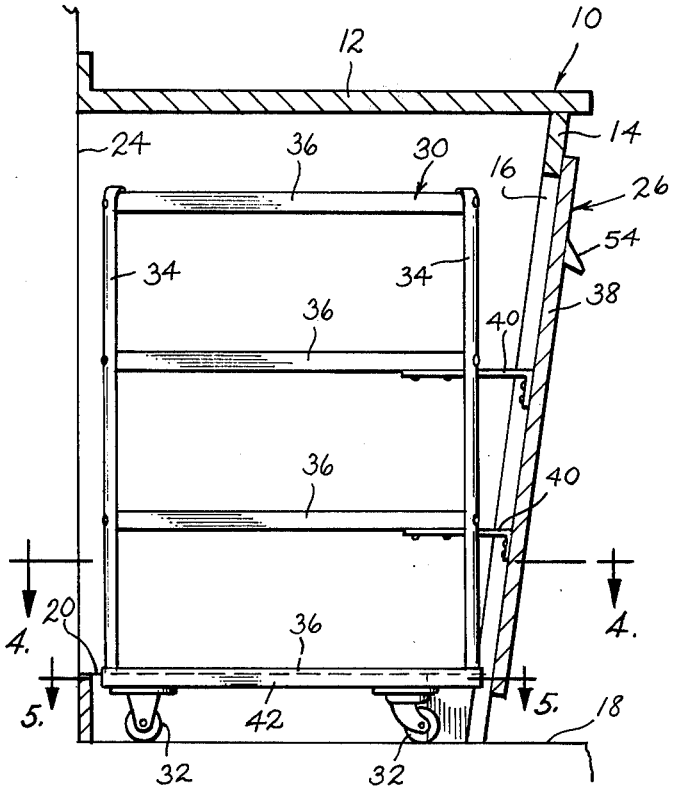
FIG. 3 is a sectional view of the cabinet and roll out drawer taken along line 3—3 of FIG. 1.
Figure 5:
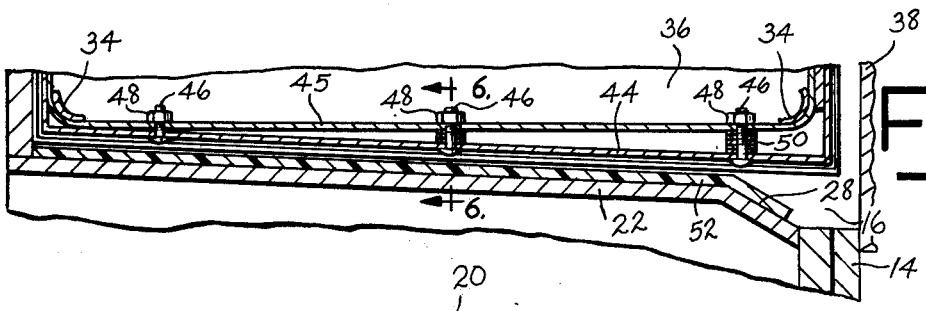
FIG. 5 is a fragmentary sectional view taken along line 5—5 of FIG. 3.
Figure 4:
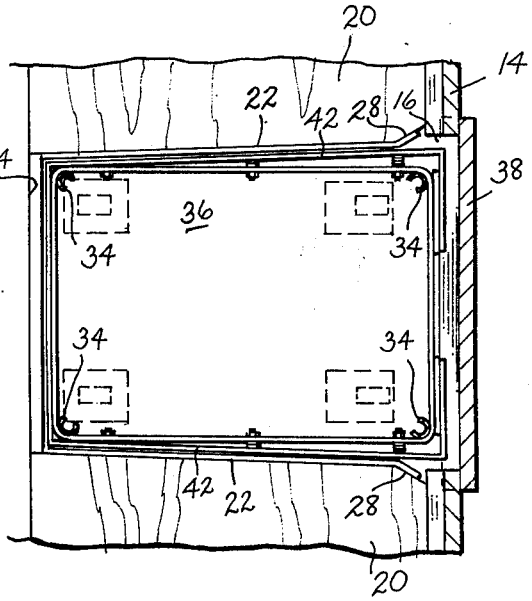
FIG. 4 is a sectional view as seen along line 4—4 of FIG. 3.
Figure 6:
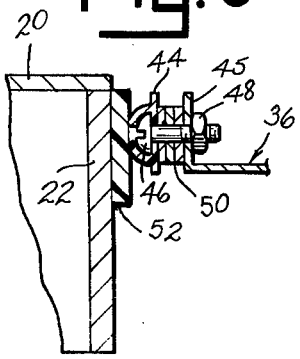
FIG. 6 is a detailed view taken along line 6—6 of FIG. 5.

The preferred embodiments illustrated are not intended to be exhaustive or to limit the invention to the precise forms disclosed. They are chosen and described in order to explain the principles of the invention and its application and practical use to thereby enable others skilled in the art to best utilize the invention.

The cabinet and roll out drawer combination depicted in FIGS. 1–6 includes a housing 10 having a flat countertop 12. Housing 10 at its front 14 has a rectangular opening 16 formed in it. Opening 16 extends to floor 18. Housing 10 includes a sub-floor 20 which is located above floor 18 upon which the housing rests. Housing floor 20 is cut away at opening 16 with a spaced pair of guide panels 22 extending vertically between floor 18 and the housing floor. Guide panels 22 extend inwardly from front 14 to the back 24 of housing 10 and taper toward one another, with the spacing between the guide panels being reduced progressively from the front to the back of the housing. A roll out drawer, illustrated generally by the reference numeral 26, is fitted into opening 16 of housing 10 and positioned between guide panels 22. To facilitate the insertion of drawer 26 into opening 16, the front end portion 28 of each guide panel 22 is beveled or angled.

Drawer 26 includes a frame 30. Four wheels 32 are connected to frame 30 permitting the drawer to be rolled in and out of opening 16 in housing 10. Wheels 32 are preferably of the swivel or caster type. Frame 30 includes four upright stanchions 34 supporting four shelves 36. A panel 38 is secured to frame 30 at the front of the frame. Brackets 40 connect panel 38 to frame 30 in such a manner that the panel is tilted inwardly and downwardly, as best shown in FIG. 3. Front 14 of housing 10 also tilts downwardly and inwardly at substantially the same angle as panel 38 of drawer 26 so that the panel will overlie and parallel the housing front when the drawer is closed. This cooperating tilt of front 14 of housing 10 and panel 38 of drawer 26 enables the cabinet to be constructed without a toe recess which is commonly present in cabinets having vertical fronts. The amount of tilt of drawer panel 38 and housing front 14 will vary, depending upon the height of top 12 and the general size of the cabinet.

The sides 42 of drawer frame 30 at its lowermost shelf 36 are also tapered or converge toward one another from the front to the rear of the drawer for the purpose of complementally filling the spacing between guide panels 22 of the housing and to engage the guide panels in a slight wedging fit. Sides 42 of drawer 26 are preferably provided with means for adjusting the angle of their taper to accommodate wear between the drawer sides and guide panels and to regulate the amount of wedging fit between the drawer and cabinet housing. This adjustment may be accomplished by providing each side 42 with an outer bumper strip 44 which is connected by means of screws 46 and nuts 48 to an upturned flange 45 formed about the edges of lower shelf 36 of frame 30. A selected number of spacer washers 50 is carried upon each screw 46 and positioned between shelf flange 45 and bumper strip 44. By proportionately decreasing the number of spacer washers 50 upon screws 46 along each drawer side 42, bumper strip 44 can be secured to drawer frame 30 with the selected taper. A wear strip 52 is secured along each guide panel 24 for the purpose of contacting bumper strip 44 of the drawer.

Panel 38 of drawer 26 carries a gripping device 54 which allows the drawer to be inserted into and pulled from opening 16 of housing 10. As illustrated in FIGS. 1 and 2, there are additional panels 56 located on each side of drawer panel 38. Panels 56 may form parts of other similar roll out type drawers or they may constitute parts of hinged doors which permit the user access into cabinet housing 10. Shelves 36 of drawer 26 can be utilized to store cooking utensils, food or similar items. By providing the cabinet with a removable drawer 26, the user of the cabinet can either roll the drawer to any of a variety of locations in the kitchen for extended periods of use of simply pull the drawer out momentarily to remove an item from one of the shelves 36.

Figure 7:
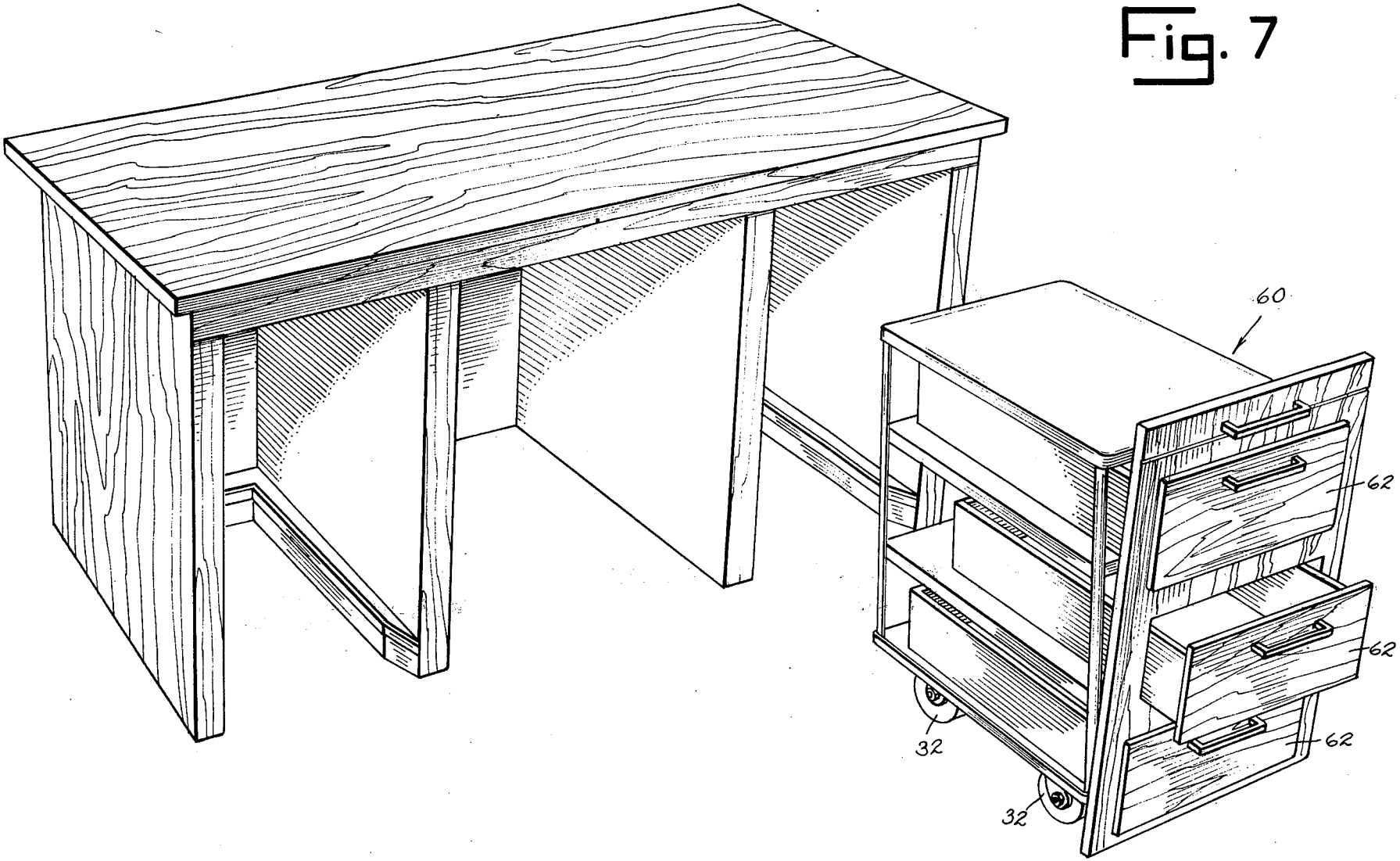
FIG. 7 is a perspective view of the combined cabinet and roll out drawer of this invention shown with the cabinet depicting an office desk having a roll out drawer of a multiple pull out drawer construction.

In FIG. 7 the combination cabinet and roll out drawer of this invention is illustrated as a desk component in which drawer 60 supported upon wheels 32 carries a plurality of individual pull out drawers 62. Drawers 62 are suitably supported within the framework of drawer 60 and in essence form a drawer within a drawer. Modification of drawer 60 could enable it to support a typewriter which, when the drawer is pulled out from its housing, can be pivoted upwardly into position for use. Additionally, drawer 60 could be modified to be used as a storage facility or a file.

It is to be understood that the invention is not to be limited to the details above given, but may be modified within the scope of the appended claims.

What I claim is:

1. A combination cabinet and roll out drawer component comprising a housing member defining said cabinet and supporting a generally flat top, said housing member including a front part having an opening formed therein beneath said top, said opening extending upwardly from a supporting foundation for said housing member and terminating below said top, said housing member including guide parts projecting upwardly from said foundation, one of said guide parts located on each side of said opening, said guide parts being spaced apart and extending rearwardly from said opening in convergent directions, said drawer component including a frame having a front and a back interconnected by sides, wheel means contacting said foundation for supporting said frame for movement over the foundation, a panel secured to said frame at its front, the sides of said frame extending from the front toward the back of the frame in convergent directions, said frame including a plurality of shelves extending from the front to the back of the frame and positioned behind said panel, said frame fitting in wedge-like fashion within said housing opening with said sides of the frame engaging said housing member guide parts, and gripping means carried by said panel for pulling upon said panel to remove said frame from said housing opening, said frame sides each including shiftable contact strip means for engaging a said housing member guide part, spacer means for shifting said contact strip means of each frame side to vary the convergence of said sides whereby the fit of the frame within said housing opening can be varied.

2. The combination of claim 1 wherein said housing member front part includes upper and lower edges and slants rearwardly from its upper to its lower edge, said panel having upper and lower edges and slanting rearwardly from its upper to its lower edge and fitting complementally against said housing front part.

* * * * *